United States Patent [19]

Cann

[11] 4,454,725

[45] Jun. 19, 1984

[54] METHOD AND APPARATUS FOR INTEGRATING A SUPPLEMENTAL HEAT SOURCE WITH STAGED COMPRESSORS IN A HEAT PUMP

[75] Inventor: Peter L. Cann, Canastota, N.Y.

[73] Assignee: Carrier Corporation, Syracuse, N.Y.

[21] Appl. No.: 427,406

[22] Filed: Sep. 29, 1982

[51] Int. Cl.[3] ..... F25B 13/00

[52] U.S. Cl. ..... 62/117; 62/238.7; 62/324.1

[58] Field of Search ..... 62/238.6, 238.7, 196.2, 62/117, 160, 324.1, 324.6

[56] References Cited

U.S. PATENT DOCUMENTS

| | | | |
|---|---|---|---|
| 2,529,154 | 11/1950 | Hammond et al. | 62/235.1 X |
| 4,033,738 | 7/1977 | Merola et al. | 62/196.2 X |
| 4,055,963 | 11/1977 | Shoji et al. . | |
| 4,257,239 | 3/1981 | Partin et al. | 62/238.7 |
| 4,268,291 | 5/1981 | Cann . | |
| 4,306,420 | 12/1981 | Cann . | |
| 4,324,105 | 4/1982 | Cann . | |
| 4,380,156 | 4/1983 | Ecker | 62/238.7 X |

*Primary Examiner*—William E. Tapolcai
*Attorney, Agent, or Firm*—David J. Zobkiw

[57] ABSTRACT

Apparatus and a method for operating a series compression refrigeration circuit with supplemental heating means are disclosed. The supplemental heat source is arranged to supply heat energy to the refrigerant being supplied to the high stage compressor suction line. A quench conduit is provided for effectively regulating the temperature of the refrigerant entering the high stage compressor. This arrangement allows for the simultaneous heating of the refrigerant for supplying supplemental heat energy and for continued utilization of the outdoor heat exchanger for absorbing heat energy from the outdoor ambient air for transfer to a space to be conditioned.

7 Claims, 5 Drawing Figures

METHOD AND APPARATUS FOR INTEGRATING A SUPPLEMENTAL HEAT SOURCE WITH STAGED COMPRESSORS IN A HEAT PUMP

BACKGROUND OF THE INVENTION

1. Field of the Invention

The present invention relates to a refrigeration circuit having multiple compressors arranged in series and a supplemental heat source. More particularly, the present invention concerns adding thermal energy via a supplemental heat source to the refrigeration circuit between the low and high stage compressors.

2. Description of the Prior Art

In a typical vapor compression refrigeration circuit various components such as a compressor, condenser, evaporator and expansion device are arranged to effect the transfer of heat energy between a fluid in heat transfer relation with the evaporator and a fluid in heat transfer relation with the condenser. In a heat pump system, an outdoor heat exchanger and an indoor heat exchanger are located such that the compressor, through a reversing valve, may direct hot gaseous refrigerant to either heat exchanger acting as a condenser. The other heat exchanger then acts as an evaporator such that, depending upon the position of the reversing valve, heat energy is either rejected or absorbed in both the indoor heat exchanger or the outdoor heat exchanger. In the heating mode of operation thermal energy is rejected at the indoor heat exchanger serving as a condenser and thermal energy is absorbed at the outdoor heat exchanger acting as an evaporator. The reverse is true in the cooling mode of operation wherein thermal energy is rejected at the outdoor heat exchanger acting as a condenser and thermal energy is absorbed at the indoor heat exchanger serving as an evaporator.

It has been found in air source heat pump applications that the capacity of the heat pump to provide heat energy diminishes as the ambient air temperature drops. Consequently, as the heating load is increasing, the capability of the heat pump to supply heat energy is decreasing. Many attempts have been made to increase the heating capacity of a heat pump system at lower temperatures. One of these methods is by providing two compressors in series such that the heating capacity of the refrigeration circuit may be substantially increased at lower ambient temperatures.

Another approach to increasing the ability of the heat pump to supply sufficient heat energy as the outdoor ambient air temperature decreases is to use an alternative source for supplying thermal energy to the refrigeration circuit. This approach has included bypassing the outdoor heat exchanger serving as an evaporator and routing the refrigerant to a fossil fuel fired furnace or boiler for supplying heat energy to the refrigeration circuit such that sufficient heat energy is dissipated or rejected at the indoor heat exchanger to satisfy the load on the enclosure. One of the potential disadvantages of utilizing an alternative heat source in this arrangement is that fossil fuel or electricity for supplying electric resistance heaters must be consumed to supply thermal energy to the refrigeration circuit in addition to the energy that must be supplied to drive the compressors. With the addition of heat energy to the refrigeration circuit the outdoor heat exchanger has been bypassed in the prior art devices such that the transfer of heat energy from the outdoor ambient air to the space to be conditioned is prevented.

The herein described apparatus and method utilizes a staged heat pump system having low and high stage compressors in series to avoid this problem. When a high heating load is present the outdoor heat exchanger is not bypassed. The low stage compressor continues to act to transfer heat energy from the outdoor ambient air to the indoor heat exchanger by drawing refrigerant through the outdoor heat exchanger wherein it is evaporated absorbing heat energy from the outdoor ambient air. Supplemental heating to increase the temperature of the refrigerant is arranged such that thermal energy is added to the refrigerant to increase the temperature of the refrigerant as it flows between the compressors. In other words, the supplemental heat source is arranged to increase the enthalpy of the refrigerant flowing through a quench conduit before it enters the high stage compressor. Hence, this refrigeration circuit allows heat energy to be transferred from the outdoor ambient air and from the supplemental heat source to the space to be conditioned.

SUMMARY OF THE INVENTION

It is an object of the present invention to provide a refrigeration circuit having series arranged compressors and a supplemental heat source.

It is a further object of the present invention to provide staged series compressors and a supplemental heat source for supplying heat energy to the refrigerant between the staged compressors.

It is a yet further object of the present invention to provide a heat pump system capable of supplying sufficient thermal energy to meet heating loads under low outdoor ambient air conditions.

It is a further object of the present invention to provide a heat pump system in combination with a supplemental heat source capable of both transferring heat energy from the outdoor ambient air and from the supplemental heat source to effect heating of a space to be conditioned.

It is a further object of the present invention to provide a safe, economical and reliable heat pump system.

These and other objects of the present invention are achieved by utilizing a reversible refrigeration circuit including a first heat exchanger, a second heat exchanger, a common line connecting the heat exchangers to each other, reversing means, a low stage compressor adapted to receive gaseous refrigerant through the reversing means from the one of said heat exchangers serving as an evaporator, said compressor increasing the temperature and pressure of said gaseous refrigerant and a high stage compressor adapted to receive gaseous refrigerant from the low stage compressor and to further increase the temperature and pressure of said refrigerant, said refrigerant being discharged through the reversing means to the one of said heat exchangers serving as a condenser. An interconnecting line is connected between the discharge from the low stage compressor and the inlet to the high stage compressor. Heating means for supplying thermal energy to the refrigerant flowing to the high stage compressor suction line are further provided.

A method of supplying thermal energy to a space to be conditioned having various heating loads utilizing a heat pump having a first stage compressor and a second stage compressor connected in series, a first heat exchanger, second heat exchanger and reversing means is further disclosed. The steps include energizing the second stage compressor to supply hot gaseous refrigerant to the one of said heat exchangers serving as a condenser when the heating load is less than a first predetermined value, energizing both the first stage compressor and the second stage compressor such that the hot gaseous refrigerant from the first stage compressor is supplied to the second stage compressor when the heating load is greater than the first predetermined value but less than a second predetermined value, and energizing both the first stage compressor and the second stage compressor and supplying thermal energy to the refrigerant between the first stage compressor and the second stage compressor to increase the amount of thermal energy supplied by the heat pump when the heating load is greater than the second predetermined value.

A method of effectively utilizing a multiple staged compressor heat pump refrigeration circuit together with a supplemental heat source to supply thermal energy to meet a varying load wherein the heat pump includes an indoor heat exchanger and an outdoor heat exchanger is further disclosed. This method includes energizing a second compressor to effectively transfer thermal energy from the outdoor heat exchanger acting as an evaporator to the indoor heat exchanger acting as a condenser; energizing both a first compressor and the second compressor in series to effectively transfer an increased amount of thermal energy from the outdoor heat exchanger to the indoor heat exchanger; and energizing both the first compressor and the second compressor in series and supplying thermal energy from the supplemental heat source to the refrigerant flowing to the second compressor to effectively transfer a further increased amount of thermal energy, a portion of said thermal energy being transferred from the outdoor heat exchanger and a portion being transferred from the supplemental heat source.

DESCRIPTION OF THE PREFERRED EMBODIMENT

The invention as described herein will refer to a residential heat pump system having a low stage compressor and a high stage compressor. It is to be understood that the invention finds like applicability to refrigeration systems designed solely for heating or for other applications. This invention also finds applicability to systems having more than two compressors and a system designed not only for providing air conditioning but for heating and other applications where heat energy is transferred. As indicated throughout the specification, heat energy is transferred to meet a heating load of a space to be conditioned. This language is intended to include a refrigeration circuit for meeting a refrigeration requirement as well as a space conditioning application.

Additionally, a supplemental heat source will be disclosed for supplying heat energy to the refrigerant between the low and high stage compressors. The supplemental heat source is shown as an electric resistance heater mounted to increase the temperature of the refrigerant. It is to be understood that any type of heat exchanger for supplying heat energy could satisfy the requirement for increasing the temperature of the refrigerant. A fossil fuel fired furnace or boiler or heat being supplied by conduction, convection, radiation or other means could be equally utilized to effectively control the addition of thermal energy to the refrigeration circuit.

Additionally, no staging of the amount of supplemental heat being supplied is indicated herein. It is to be understood that the amount of heat energy supplied to the refrigerant between stages may be effectively regulated in conjunction with the overall load on the entire refrigeration circuit to most efficiently match the energy input to the supplemental heater with the building load.

As shown herein a single expansion device is utilized to regulate refrigerant flow through the quench conduit to the high stage compressor suction line. Multiple expansion devices and conduits could be utilized such that one controls quench flow to regulate the amount of superheat in the refrigerant entering the high stage suction line and a separate expansion device regulates refrigerant flow through the heater for absorbing heat energy therefrom. A single expansion device as shown herein can serve both functions.

Figure 1:
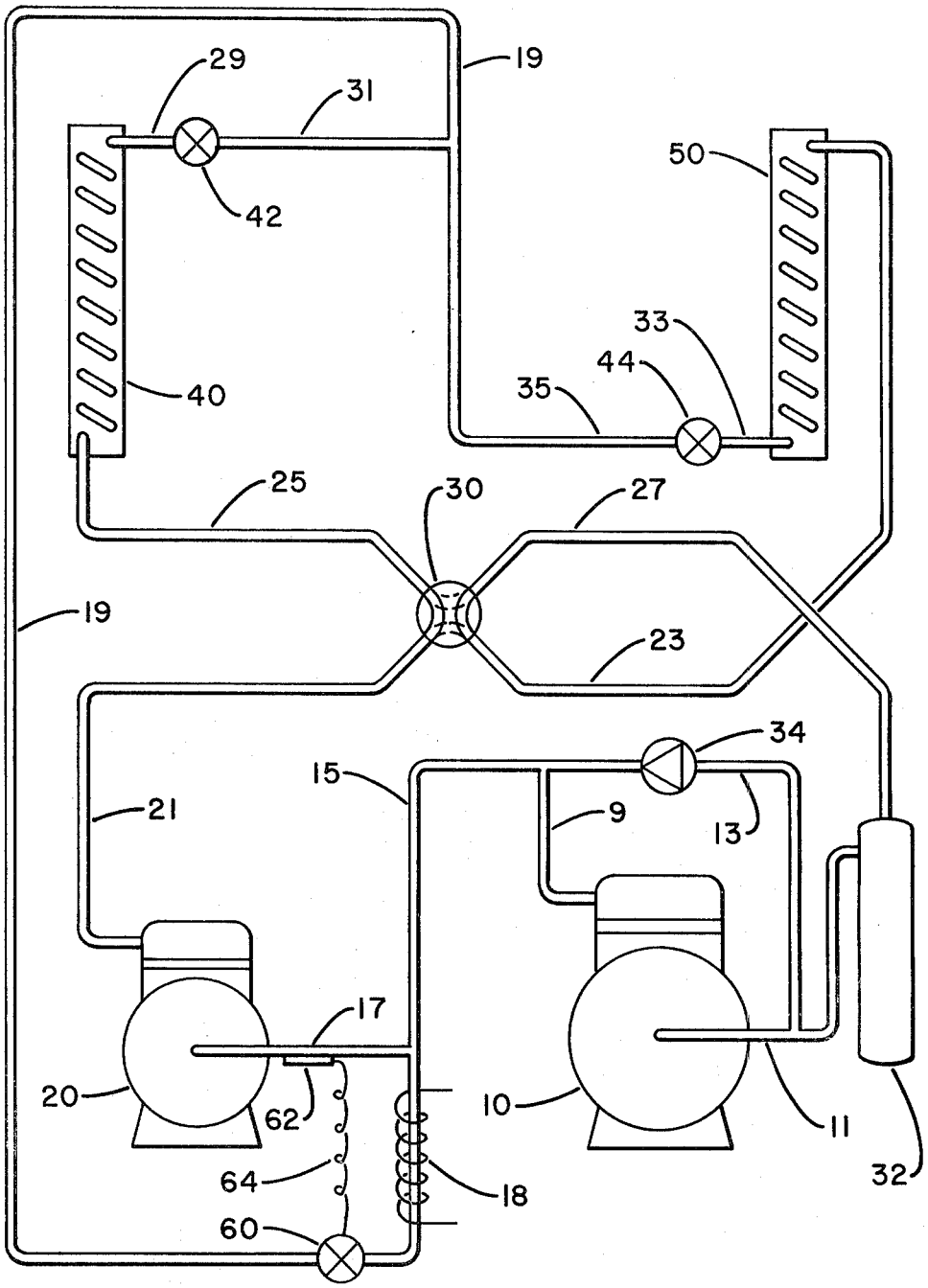
FIG. 1 is a schematic view of a series compressor refrigeration system.

Referring now to FIG. 1, there can be seen a vapor compression refrigeration system having a low stage compressor 10, a high stage compressor 20, a four-way or reversing valve 30, indoor heat exchanger 40 and outdoor heat exchanger 50. Low stage compressor 10 receives refrigerant through low stage compressor suction line 11 which is connected to accumulator 32. Low stage compressor 10 discharges refrigerant through low stage compressor discharge line 9 to interconnecting line 15. Interconnecting line 15 is connected to the high stage compressor suction line 17 which delivers refrigerant to the high stage compressor 20. High stage compressor discharge line 21 is connected to four-way valve 30 as is line 27 connecting the four-way valve to accumulator 32. Line 25 connects the four-way valve to indoor heat exchanger 40 and line 23 connects the four-way valve to the outdoor heat exchanger 50. Line 29 connects indoor heat exchanger 40 to expansion device 42 which is connected by line 31 to common line 35. Common line 35 is likewise connected to expansion device 44 which is connected through line 33 to outdoor heat exchanger 50.

A bypass of the low stage compressor is provided via line 13, check valve 34 and interconnecting line 15. As can be seen in FIG. 1, line 13 connects low stage compressor suction line 11 to interconnecting line 15. Check valve 34 is mounted to line 13 to regulate the flow of refrigerant therethrough.

Quench conduit 19 connects common line 35 to interconnecting line 15. Thermal expansion valve 60 is mounted to regulate the flow of refrigerant through the quench line. Bulb 62 is connected by tube 64 to thermal expansion valve 60 to sense the temperature of gaseous refrigerant enntering the high stage compressor through high stage compressor suction line 17. The flow of liquid refrigerant through quench line 19 is regulated as a function of the temperature of the gaseous refrigerant flowing through high stage compressor suction line 17 by controlling the volume flow therethrough with thermal expansion valve 60.

Supplemental heat source or heater 18 is shown mounted about a portion of quench conduit 19 for supplying heat energy to the refrigerant flowing from common line 35 to high stage suction line 17 such that within quench conduit 19 the enthalpy of the refrigerant is increased by changing the quality of the liquid refrigerant such that a portion changes state from a liquid to a gas.

Figure 2:
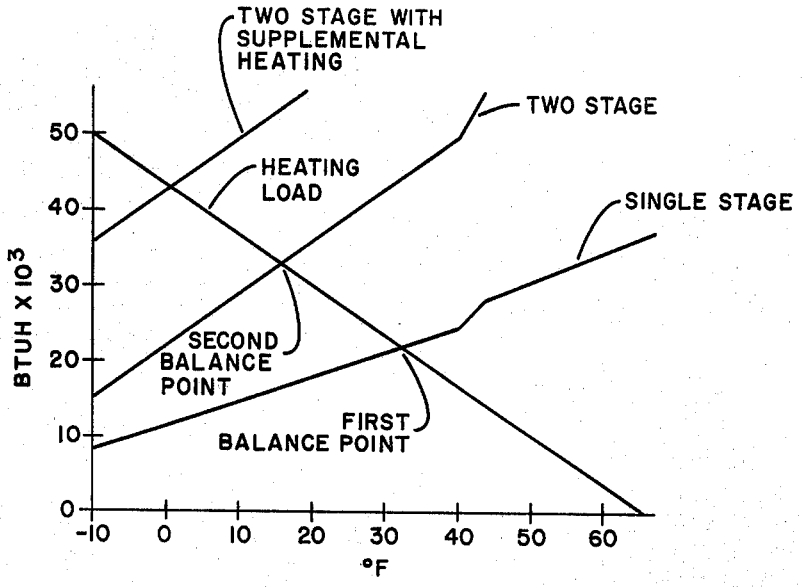
FIG. 2 is a graph of heating load in BTU's per hour versus outdoor ambient air temperature in degrees Fahrenheit.

Referring now to FIG. 2 there may be seen a graph of heating load in BTU's per hour versus outdoor ambient air temperature in degrees Fahrenheit for a selected enclosure. The graph includes a line labeled heating load which shows that as the temperature decreases, from right to left on the graph, the heating load increases. The graph additionally contains lines showing the capability of the described heat pump system for supplying heat energy to the space to be conditioned. As can be seen, the slope of the various lines indicating the output of the heat pump is opposed to the slope of the heating load line indicating that as the outdoor ambient air temperature decreases the capability of the heat pump to supply heat energy decreases. A single stage line is indicated to show the amount of thermal energy that the heat pump may effectively transfer at various outdoor ambient air temperatures with only the high stage compressor operating. The point at which the single stage line crosses the heating load line is labeled the first balance point. At any temperature below said point the second stage of the compressor operating alone is incapable of satisfying the heating needs of the space to be conditioned.

A two stage line spaced from the single stage line reflects the capability of the heat pump to transfer thermal energy with both compressors operating and crosses the heating load line at a point having a lower outdoor ambient air temperature than the first balance point. This point is indicated to be the second balance point and reflects that point at which the heat pump system with both compressors operating is capable of satisfying the load on the space to be conditioned. At any temperature lower than the second balance point operation of both compressors is insufficient to satisfy the heating load of the enclosure. The third line labeled two stage with supplemental heating is shown to indicate the amount of heat energy that may be transferred to the enclosure with both compressors operating and with the supplemental heat source being energized. As may be seen with both compressors operating and with the supplemental heat source the load on the enclosure may be fully met to an outdoor ambient air temperature of approximately 0° F.

Figure 3:
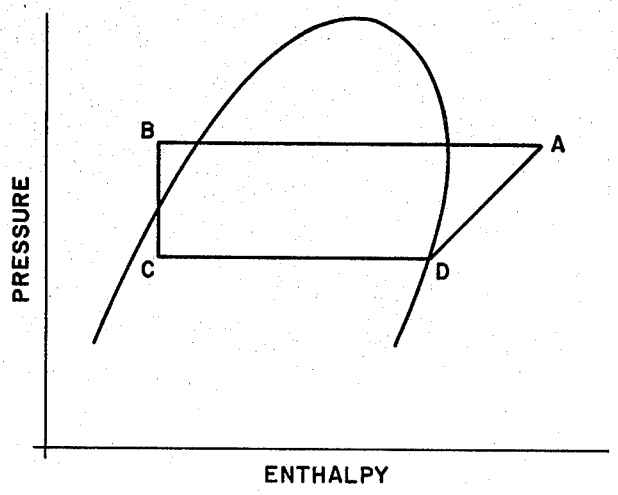
FIG. 3 is a pressure enthalpy diagram of a typical single stage refrigeration circuit.
Figure 4:
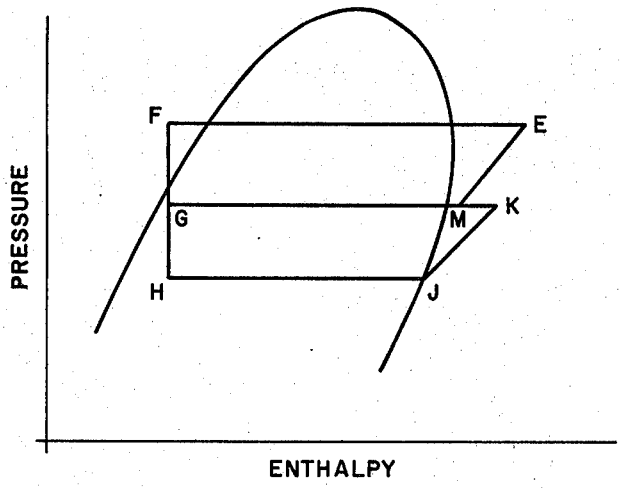
FIG. 4 is a pressure enthalpy diagram of a staged compressor refrigeration circuit.
Figure 5:
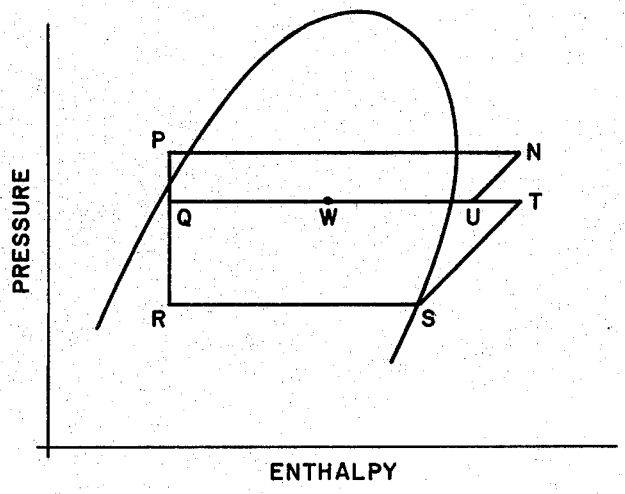
FIG. 5 is a pressure enthalpy diagram of a staged compressor refrigeration circuit with supplemental heat energy supplied between the compressor stages.

FIGS. 3 through 5 are pressure enthalpy diagrams of refrigeration circuits. The portion of the diagram under the curve indicates a two phase (gas and liquid) refrigerant mixture. Those portions of the diagram to the left of the curve indicate liquid refrigerant and those portions to the right of the curve indicate gaseous refrigerant. FIG. 3 is a pressure enthalpy diagram of a single compressor refrigeraton circuit. Line D to A indicates the increased pressure and enthalpy as the compressor acts to increase the temperature and pressure of gaseous refrigerant. Line A to B indicates the change in enthalpy of the refrigerant as it flows through the heat exchanger serving as the condenser. As the refrigerant flows from point A to point B it flows in the portion of the diagram entirely to the right of the curved line which is the gaseous state of refrigerant into the mixed phase state between the two curved lines and eventually flows to point D which is a subcooled liquid state being at a temperature below the condensation temperature of the refrigerant. The refrigerant then flows from point B to point C as it is flashed through an expansion device undergoing a reduction in pressure. The refrigerant is then evaporated moving from point C to D absorbing heat energy as it changes state from a liquid to a gas and is conducted back to the compressor to complete the refrigeration circuit.

Referring now to FIG. 4, a two stage system is described. The low stage compressor increases the temperature and pressure of the refrigerant such that its enthalpy increases from point J to point K. The refrigerant is then quenched as by quench conduit 19 controlled by the thermal expansion valve in FIG. 1 such that the enthalpy is reduced from point K to point M. The high stage compressor then increases the temperature and pressure of the refrigerant from point M to point E. Refrigerant is then conducted to the condenser and is changed from a superheated gas at point E to subcooled liquid at point F. A portion of the refrigerant is then reduced in pressure and conducted from point G to point M, said portion being the portion that passes through the quench circuit changing state from a liquid to a gas and absorbing superheat energy from the gaseous refrigerant at point K such that it is reduced in enthalpy from point K to point M. The remainder of the liquid refrigerant undergoes a pressure drop from point F to point H at the expansion device and is then evaporated in the evaporator indicated by the line from point H to point J absorbing heat energy.

FIG. 5 is a pressure enthalpy diagram for a staged compressor refrigeration circuit including supplemental heating means. As in FIG. 4, a low stage compressor increases the temperature and pressure of the refrigerant such that it increases in pressure and enthalpy from point S to point T. The refrigerant then is quenched as previously explained and as a result of the quench would have its superheat energy removed and enthalpy reduced from point T to point U. However, the heater additionally supplies heat energy to the refrigerant such that refrigerant increases in enthalpy from point Q to point W. From point U to point N the high stage compressor acts to increase the temperature and pressure of the refrigerant, again, increasing its enthalpy. From point N to point P the superheated refrigerant is condensed and subcooled. From point P to point Q a portion of the refrigerant is decreased to the intermediate pressure via the expansion valve and changes state from a liquid to a liquid and gas mixture as indicated by the line from point P to point Q. Heat energy is absorbed from the superheated gas at point T as a portion of the refrigerant is evaporated. Additionally, the heater supplies sufficient heat energy to increase the enthalpy from point Q to W acting to change the quality of the refrigerant. This quenched gas, after being increased in enthalpy to point W, is combined with the superheated gas from point T and has a combined enthalpy indicated by point U. Additionally, refrigerant is conducted from point P to point R via an expansion device and is then evaporated to absorb heat energy as indicated by the line from point R to point S.

Operation

When a need for single stage operation only is sensed, the high stage compressor is operated to supply heating to the enclosure and refrigerant is bypassed via bypass line 13 and through check valve 34 around the low stage compressor. When a need for two stage operation is sensed, both compressors are energized and gaseous refrigerant flows into low stage compressor 10 and through low stage compressor suction line 11. Refrigerant is then increased in temperature and pressure and discharged through low stage compressor discharge line 9 to interconnecting line 15 to high stage compressor suction line 17.

Consequently, the increased temperature and pressure of the gas discharged by compressor 10 is directed into high stage compressor 20 wherein the temperature and pressure are further increased. Since this double step of increasing the temperature and pressure in both compressors may result in the temperature of the refrigerant and any oil contained therein being sufficiently high for degradation, it is desirable to use quench line 19 and thermal expansion valve 60 to supply refrigerant to decrease the temperature of the refrigerant entering the high stage compressor. Additionally, by decreasing the temperature the mass flow rate may be increased to improve the overall performance of the high stage compressor.

Expansion devices 42 and 44 are shown associated with the heat exchangers. Each of these expansion devices serves to meter refrigerant when flow direction is one way and to allow refrigerant to flow therethrough without restriction when the direction of refrigerant flow is in the opposite direction. Consequently, when the unit is in the heating mode, liquid refrigerant is supplied from the indoor heat exchanger 40, passes through expansion device 42 without restriction and then is metered through expansion device 44 to create a pressure drop. In the cooling mode of operation, the opposite occurs with the liquid refrigerant being conducted from the outdoor heat exchanger 50 where it is then condensed through expansion device 44 without undergoing a pressure drop and then through expansion device 42 where it is metered to create a pressure drop such that the indoor heat exchanger may act as an evaporator. In either mode of operation, liquid refrigerant flows through common line 35 which is connected to quench line 19. Consequently, regardless of the mode of operation, liquid refrigerant is supplied through quench line 19 to a control device shown as thermal expansion valve 60. This device may be any regulating device which serves to control the flow of refrigerant through quench line 19 and simultaneously to meter said refrigerant such that it undergoes a pressure drop from the high stage compressor discharge pressure to the high stage compressor suction pressure such that this liquid refrigerant flashes to a liquid and gas mixture. By providing a mixture of refrigerant from the quench conduit with refrigerant discharged from the low stage compressor the overall gaseous refrigerant temperature entering the high stage compressor is decreased to prevent oil and refrigerant degradation and aid in the overall efficiency of the high stage compressor.

Bulb 62 is located on the high stage compressor suction line such that it senses the temperature or superheat of the gaseous refrigerant entering the high stage compressor. By sensing this temperature, thermal expansion valve 60 is regulated to either increase or decrease the flow of liquid refrigerant therethrough for providing the appropriate amount of flash cooling of the gaseous refrigerant entering the high stage compressor.

When the unit senses that additional heating is required, heater 18 is energized to further increase the enthalpy of the refrigerant flowing through the quench conduit to the high stage compressor suction line. When this additional load is sensed, typically te operating conditions will be such that the outdoor ambient air temperature is low. The quench circuit is utilized in this mode of operation to effectively regulate the temperature of the refrigerant being conducted to the high stage suction line 17 such that the oil degradation or other potential adverse effects of a refrigerant at high superheat leaving the high stage compressor are avoided. The addition of heat energy to the quench conduit effectively allows the high stage compressor to not realize the level of the outdoor ambient temperature since the amount of heat energy being added to the refrigerant prior to it entering the high stage compressor is effectively controlled regardless of the outdoor ambient air temperature. In other words, by effectively regulating the amount of heat energy supplied through heater 18 the saturated temperature of the refrigerant entering the high stage compressor may be maintained constant regardless of fluctuations in outdoor ambient air temperature.

While the invention has been described in reference to preferred embodiment, it is to be understood by those skilled in the art that modifications and variations can be effected within the spirit and scope of the invention.

What is claimed is:

1. A reversible refrigeration circuit which comprises:

a first heat exchanger;

a second heat exchanger;

a common line connecting the heat exchangers to each other;

reversing means;

a low stage compressor adapted to receive gaseous refrigerant through the reversing means from the one of said heat exchangers serving as an evaporator, said compressor increasing the temperature and pressure of said gaseous refrigerant;

a high stage compressor adapted to receive gaseous refrigerant from the low stage compressor and to further increase the temperature and pressure of said refrigerant, said refrigerant being discharged through the reversing means to the one of said heat exchangers serving as a condenser;

an interconnecting line connecting the discharge from the low stage compressor to the inlet to the high stage compressor;

a conduit connecting the common line with the interconnecting line and control means for regulating the flow of liquid refrigerant through the conduit; and heating means for supplying thermal energy to the refrigerant flowing through the conduit to the high stage compressor.

2. The apparatus as set forth in claim 1 wherein the control means further comprises a temperature sensor for monitoring the temperature of the refrigerant supplied to the high stage compressor, and said control means further metering liquid refrigerant to the interconnecting line as a function of the temperature sensed by the sensor, said metered refrigerant flashing to a liquid and gas mixture to absorb thermal energy.

3. A method of supplying thermal energy to a space to be conditioned having various heating loads utilizing a heat pump having a first stage compressor and a second stage compressor connected in series, a first heat exchanger, a second heat exchanger and a reversing means which comprises the steps of:

energizing the second stage compressor to supply hot gaseous refrigerant to the one of said heat exchangers serving as a condenser when the heating load is less than a first predetermined value;

energizing both the first stage compressor and the second stage compressor such that hot gaseous refrigerant from the first stage compressor is supplied to the second stage compressor when the heating load is greater than the first predetermined value but less than a second predetermined value;

selectively routing a portion of refrigerant from said condensor to said second stage compressor; and energizing both the first stage compressor and the second stage compressor and supplying thermal energy to the refrigerant routed to the second stage compressor from the condenser to increase the amount of thermal energy supplied by the heat pump when the building load is greater than the second predetermined value.

4. The method as set forth in claim 3 and further comprising the step of:

quenching the refrigerant supplied to the high stage compressor by flashing liquid refrigerant from the condenser therewith to effectively control the degree to which the refrigerant is superheated.

5. The method as set forth in claim 3 wherein the step of energizing the second stage compressor alone includes the step of bypassing the first stage compressor such that the refrigerant does not flow through the first stage compressor.

6. A method of effectively utilizing a multiple staged compressor heat pump refrigeration circuit together with a supplemental heat source to supply thermal energy to meet a varying load wherein the heat pump includes an indoor heat exchanger and an outdoor heat exchanger which comprises the steps of:

energizing a second compressor to effectively transfer thermal energy from the outdoor heat exchanger acting as an evaporator to the indoor heat exchanger acting as a condenser;

energizing both a first compressor and the second compressor in series to effectively transfer an increased amount of thermal energy from the outdoor heat exchanger to the indoor heat exchanger;

selectively routing a portion of refrigerant from said condensor to said second stage compressor; and energizing both the first compressor and the second compressor in series and supplying thermal energy from the supplemental heat source to refrigerant flowing from the condenser to the second compressor to effectively transfer a further increased amount of thermal energy, a portion of said thermal energy being transferred from the outdoor heat exchanger and a portion being transferred from the supplemental heat source.

7. The method as set forth in claim 6 wherein when both the first and second compressors as well as the supplemental heat source are energized the first compressor effectively transfers heat energy from the outdoor heat exchanger while the second compressor effectively transfers heat energy from both the supplemental heat source and the outdoor heat exchanger.

* * * * *